US006425358B1

(12) United States Patent
Haas et al.

(10) Patent No.: US 6,425,358 B1
(45) Date of Patent: Jul. 30, 2002

(54) SWITCHABLE SUPPORT ELEMENT

(75) Inventors: Michael Haas; Bodo Rörig, both of Weisendorf; Dieter Schmidt, Nürnberg; Joachim Seitz, Reundorf, all of (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/946,565

(22) Filed: Sep. 5, 2001

Related U.S. Application Data

(60) Provisional application No. 60/237,300, filed on Oct. 2, 2000.

(51) Int. Cl.[7] ..... F01L 1/24; F01L 13/00

(52) U.S. Cl. ..... 123/90.16; 123/90.43; 123/198 F

(58) Field of Search ..... 123/90.15, 90.16, 123/90.41, 90.42, 90.43, 198 F

(56) References Cited

U.S. PATENT DOCUMENTS 5,655,487 A * 8/1997 Maas et al. ..... 123/90.16
5,720,244 A * 2/1998 Faria ..... 123/90.16
6,196,175 B1 * 3/2001 Church ..... 123/90.16
6,321,704 B1 * 11/2001 Church et al. ..... 123/90.16

FOREIGN PATENT DOCUMENTS

DE 4422340 A1 * 1/1995

* cited by examiner

*Primary Examiner*—Weilun Lo
(74) *Attorney, Agent, or Firm*—Bierman, Muserlian and Lucas

(57) ABSTRACT

A switchable, hydraulic support element (1) requiring only a small design space is proposed. For achieving this, a bore (16) for a slide (23) is arranged laterally of a pressure piston (10) of a hydraulic clearance compensation element (11) in the inner element (7) and is configured as a pocket bore. This dispenses with the stacked arrangement of the bore in the inner element and the clearance compensation element on top of each other as seen in prior art. At the same time, the slide (23) is installed in a housing (19) that extends in the cylinder head (5).

4 Claims, 1 Drawing Sheet

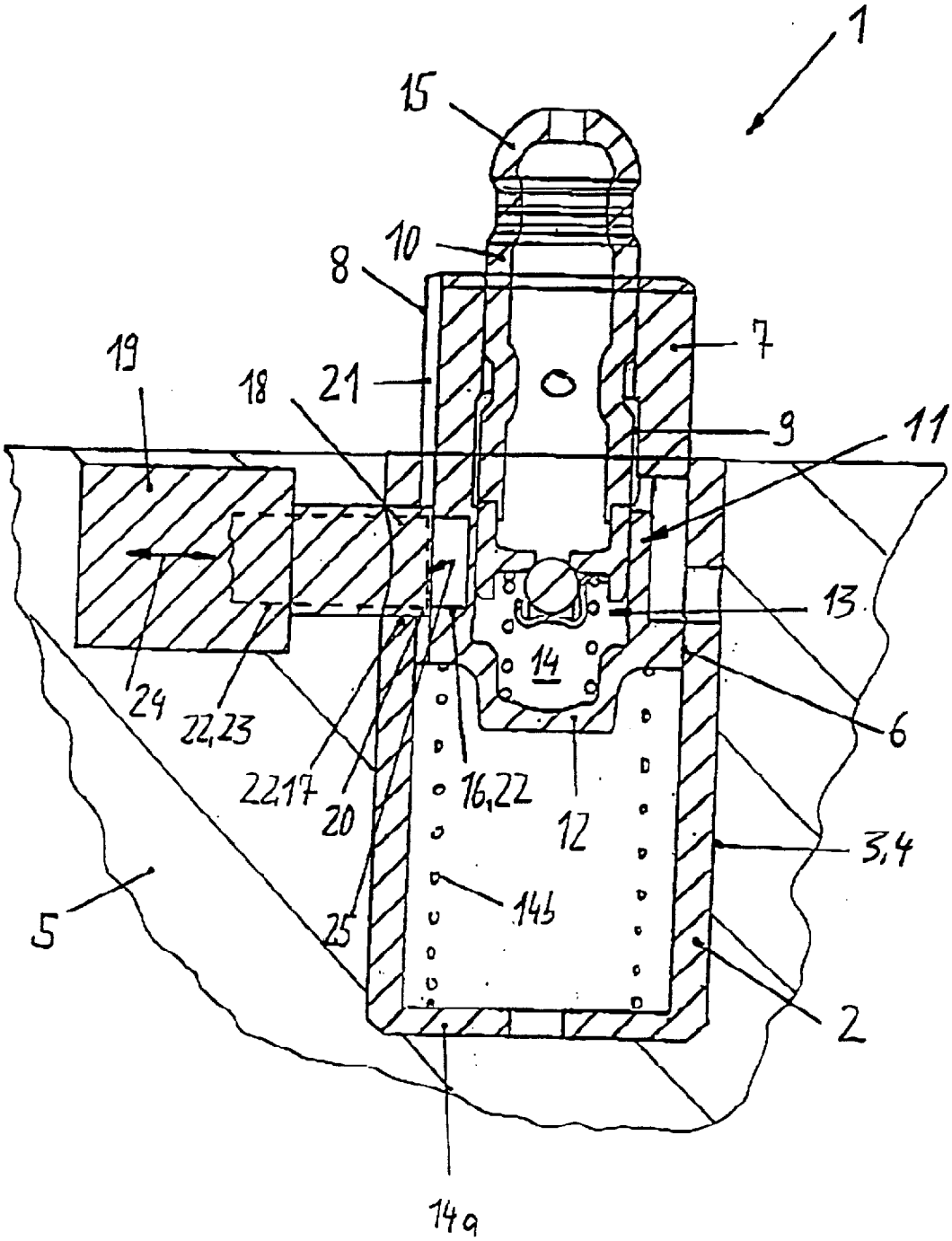
1
15
10
8
7
19
18
21
9
11
13
14
24
22,23
6
22,17
20
16,22
12
3,4
5
25
14b
2
14a

SWITCHABLE SUPPORT ELEMENT

This application claims priority from provisional application Ser. No. 60/237,300, filed Oct. 2, 2000.

FIELD OF THE INVENTION

The invention concerns a switchable support element for a valve train of an internal combustion engine, said support element having an outer housing, an inner element, a hydraulic clearance compensation element and a coupling means, the outer housing being installed with an outer peripheral surface in a reception of a cylinder head and comprising a longitudinal bore within which, in an uncoupled state, the inner element is axially displaceable, the inner element comprising a further bore in which a pressure piston having a head and forming a part of the clearance compensation element is received, said coupling means comprising at least one bore extending in radial or in secant direction in each of the inner element and the outer housing and at least one associated slide, said bores being aligned to each other in a relative position of the inner element and the outer housing, and the slide being partially displaceable by an actuating means from the bore of the outer housing into the bore of the inner element for achieving coupling.

BACKGROUND OF THE INVENTION

A switchable support element of the -pre-cited type is known from DE 44 22 340 A1. For a return movement of its inner element in cam direction, this support element comprises a so-called lost motion compression spring which increases the design length. The bore for the slide in the inner element extends radially through the entire inner element and is arranged beneath the clearance compensation element in axial direction. This is an unfavorable stacked-up construction. Since, for example, cooling water ducts and gas exchange channels extend in the immediate vicinity of the reception for the support element in the cylinder head, the installation depth available for the relatively long support element is limited, or complicated modifications must be made to existing cylinder heads. However, such modifications are often not possible because they would interfere with flow conditions, particularly in the gas exchange channels.

OBJECT OF THE INVENTION

The object of the invention is therefore to provide a switchable support element of the pre-cited type in which the mentioned drawbacks are eliminated by simple measures.

SUMMARY OF THE INVENTION

The invention achieves this object by the fact that the bore of the inner element is made as a pocket bore whose axial line intersects the further bore of the inner element.

In this way, the aforesaid drawbacks are eliminated by simple measures. The prior art stacked arrangement of the clearance compensation element and the bore for the slide in the inner element is avoided. Thus, a switchable support element is obtained that has a shorter design length than the above-mentioned prior art solutions and can thus be installed more easily in existing cylinder head constructions.

It goes without saying that it is also possible to use a plurality of circumferentially spaced coupling means which results in better load-bearing properties.

In an advantageous embodiment of the invention, the actuating means for the slide that is made, for instance, as a rod, is installed in a housing that extends in the cylinder head and adjoins the reception of the outer housing. It is proposed at the same time to create a simple anti-rotation device for the inner element relative to the outer housing through the inner end of a section of the housing. In addition, an upper stop for the inner element relative to the outer housing can also be realized in this region. Due to these measures, further anti-rotation and upper stop means can be dispensed with. Advantageously, the housing for the actuating means is arranged in a region of the cylinder head that intersects neither the above-mentioned cooling ducts and gas exchange channels nor spark plug holes, camshaft bearings and the like.

Thus, for the most part, the slide with its actuating means is situated outside of the support element and is applied to this only in radial or in secant direction. However, it is also conceivable to make the slide engage at a slant or to effect a direct coupling, for instance, through balls, catches or pins actuated by the slide so that the slide itself is not a directly engaging element.

According to another advantageous feature of the invention, the slide is actuated electromagnetically or hydraulically. For example, the outer end surface of the slide can define a pressure chamber for hydraulic medium, or the slide can be configured as an actuator rod comprising an armature plate for electromagnetic actuation.

According to a final proposition of the invention, a means for re-setting the slide against the force of the electromagnetic or hydraulic actuating means may also be installed in the housing. This a further -measure towards reducing the dimensions of the switchable support element.

The scope of the invention also includes a solution in which the support element is not completely but only partly disconnectable from cam lift. It is also conceivable to realize switching steps by arranging bores for the slide at different heights in the inner element.

BRIEF DESCRIPTION OF THE DRAWING

The invention will now be described more closely with reference to the drawing.

The sole FIGURE is a schematic representation of a switchable support element in longitudinal section.

DETAILED DESCRIPTION OF THE DRAWING

FIG. 1 discloses a switchable support element 1. This comprises an outer housing 2 that is fixedly installed with its outer peripheral surface 3 in a reception 4 of a cylinder head 5. The outer housing 2 comprises a longitudinal bore 6 in which an inner element 7 extends with its outer peripheral surface 8. An axially displaceable pressure piston 10 forming a part of a hydraulic clearance compensation element 11, not specifically described, is installed in a bore 9 of the inner element 7. A high pressure chamber 14 for hydraulic medium extends between a bottom 12 of the inner element 7 and an opposing one-way valve 13. At the same time, a lost motion spring 14*b* is constrained between the bottom 12 and a bottom 14*a* of the outer housing 2. The FIGURE further discloses that the pressure piston 10 possesses a head 15 that extends beyond the inner element 7. This head 15 serves as a support for a switchable or a non-switchable finger lever, not illustrated.

Each of the inner element 7 and the outer housing 2 possesses a bore 16, 17, which bores are aligned to each other in the illustration of the figure. The bore 16 of the inner element 7 is configured as a pock ore and extends at a level of the pressure piston 10. Its axial line therefore intersects the bore 9 of the inner element 7.

The bore 17 of the outer housing 2, in contrast, is made as a through-bore. A housing section 18 of a housing 19 extends in this bore 17. An inner end 20 of the housing section 18 extends into an axial groove 21 of the outer peripheral surface 8 and is laterally surrounded by this axial groove 21. This configuration serves as an anti-rotation device of the inner element 7 relative to the outer housing 2 and thus also serves to assure a circumferential positional correspondence of the bores 16, 17. An axial positional correspondence of the bores 16, 17 may also be assured by providing that a step, not shown, in the axial groove 21 engages the underside of the inner end 20.

The bores 16, 17 form a part of a coupling means 22. A further part of the coupling means 22 is a slide 23, only roughly indicated in the figure. This slide 23 extends in the housing 19 and is surrounded by the housing section 18. In the illustration of the drawing, the bores 16, 17 are aligned to each other so that it would be possible to displace the slide 23 with its inner end 25 partially into the bore 16 of the inner element 7 through the force of its actuating means 24. The support element 1 would then be in a switched-on state and the gas exchange valve loaded by the finger lever would open in direction of maximum lift. For switching off the support element 7, the actuating means 24, or a re-setting means, not shown, such as a compression spring would displace the slide 23 back into the housing 19 till the bore 16 of the inner element 7 is disengaged. Upon cam lift, the inner element 7 can thus be displaced relative to the housing 2. The gas exchange valve would remain closed and the finger lever would pivot on the support element.

A particular advantage of the invention is that the support element 1 requires only a very small design space. Because the bore 16 of the inner element 7 is arranged laterally of the pressure piston 10 and made only as a pocket bore, the stacked arrangement of the through-bore in the inner element for the slide and the hydraulic clearance compensation element on top of each other as found in prior art configurations is not required.

LIST OF REFERENCE NUMERALS

1 Support element
2 Outer housing
3 Outer peripheral surface
4 Reception
5 Cylinder head
6 Longitudinal bore
7 Inner element
8 Outer peripheral surface
9 Bore
10 Pressure piston
11 Hydraulic clearance compensation element
12 Bottom
13 One-way valve
14 High pressure chamber
**14*a*** Bottom
**14*b*** Lost motion spring
15 Head
16 Bore
17 Bore
18 Housing section
19 Housing
20 Inner end
21 Axial groove
22 Coupling means
23 Slide
24 Actuating means
25 Inner end

What is claimed is:

1. A switchable support element (1) for a valve train of an internal combustion engine, said support element (1) having an outer housing (2), an inner element (7), a hydraulic clearance compensation element (11) and a coupling means (22), the outer housing (2) being installed with an outer peripheral surface (3) in a reception (4) of a cylinder head (5) and comprising a longitudinal bore (6) within which, in an uncoupled state, the inner element (7) is axially displaceable, the inner element (7) comprising a further bore (9) in which a pressure piston (10) having a head (15) and forming a part of the clearance compensation element (11) is received, said coupling means (22) comprising at least one bore (16, 17) extending in radial or in secant direction in each of the inner element (7) and the outer housing (2) and at least one associated slide (23), said bores (16, 17) being aligned to each other in a relative position of the inner element (7) and the outer housing (2), and the slide (23) being partially displaceable by an actuating means (24) from the bore (17) of the outer housing (2) into the bore (16) of the inner element (7) for achieving coupling, characterized in that the bore (16) of the inner element (7) is made as a pocket bore whose longitudinal axis intersects the further bore (9) of the inner element (7).

2. A support element according to claim 1, characterized in that the slide (23) is configured as a rod that, in an uncoupled state, extends with its inner end (25) in front of the bore (16) of the inner element (7), the actuating means (24) extends in a housing (19) arranged in the cylinder head (5), said housing (19) extends with a housing section (18) opposing the inner element (7) through the bore (17) of the outer housing (2) and is guided through an inner end (20) in an axial groove (21) or depression of an outer peripheral surface (8) of the inner element (7).

3. A support element according to claim 1 characterized in that the slide (23) is displaceable by an electromagnetic or hydraulic actuating means (24).

4. A support element according to claim 3, characterized in that a re-setting means acts in a direction opposed to a displacing direction of the actuating means (24) while being likewise installed in the housing (19).

* * * * *